US005857232A

United States Patent [19]

Mahdavi

[11] Patent Number: 5,857,232

[45] Date of Patent: Jan. 12, 1999

[54] MATTRESS FOR CRIBS AND BASINETS FOR SUDDEN INFANT DEATH PREVENTION

[76] Inventor: Habib Mahdavi, 11504 Canton Dr., Studio City, Calif. 91604

[21] Appl. No.: 567,368

[22] Filed: Dec. 4, 1995

[51] Int. Cl.[6] ..... A47D 7/00; A47C 27/00

[52] U.S. Cl. ..... 5/655; 5/724; 5/697

[58] Field of Search ..... 5/655, 461, 468, 5/469, 638, 922, 427, 697; 4/572.4

[56] References Cited

U.S. PATENT DOCUMENTS

| | | | |
|---|---|---|---|
| 1,736,341 | 11/1929 | Eiser | 5/655 |
| 2,551,727 | 5/1951 | Costello | 5/638 |
| 2,560,575 | 7/1951 | Holland, Sr. | 4/572.1 |
| 2,695,415 | 11/1954 | Holton | 5/655 |
| 2,924,832 | 2/1960 | Knowles | 5/468 |
| 3,089,153 | 5/1963 | Bosc | 5/655 |
| 3,837,019 | 9/1974 | Hoff | 4/572.1 |
| 5,406,655 | 4/1995 | Sahlin | 5/655 |

*Primary Examiner*—Alexander Grosz
*Attorney, Agent, or Firm*—Blakely Sokoloff Taylor & Zafman

[57] ABSTRACT

The present invention provides a safety device and a method to counter a potential cause of Sudden Infant Death Syndrome. A frame, fit to the dimensions of a crib or bassinet is equipped with an air permeable material that allows for the free flow of fresh air to an infant's mouth and offsets any exhaled carbon dioxide that lingers by the infant's air passages. The material is of a particular elasticity that an infant's weight does not cause the material to collapse on itself, thereby keeping the supply of fresh air retained in the material in place.

5 Claims, 6 Drawing Sheets

MATTRESS FOR CRIBS AND BASINETS FOR SUDDEN INFANT DEATH PREVENTION

BACKGROUND OF THE INVENTION

The present invention relates generally to an apparatus for the prevention of sudden infant death syndrome, and more particularly to a mattress for bassinets or cribs which provides for a supply of fresh air to an infant's mouth and prevents the infant's asphyxiation from carbon dioxide poisoning.

Each year, thousands of infants (aged 2 weeks to 1 year) die from Sudden Infant Death Syndrome (SIDS), a mysterious disorder in which otherwise healthy infants seemingly stop breathing. Although scientific and medical research has uncovered factors which indicate a predisposition to the disorder (i.e., low birth weight, age of mothers) no specific cause has been uncovered. Moreover, there are varied theories put forth by the medical community as to the cause of SIDS. Some theories suggest a neurological disorder in the infants which intercepts the breathing functions while sleeping and leads to the infant's death by asphyxiation.

Applicant believes a contributing cause of SIDS is that infants fall victim to asphyxiation from carbon dioxide poisoning. More specifically, infants sleeping face down rebreathe the carbon dioxide in the exhaled air trapped in the air pocket of their bedding near their air passages. Doctors, nurses and medical journals have for years recommended placing an infant on its back for sleeping to avoid this concern. However, many parents and caregivers are reluctant to follow this advice. Some infants prefer sleeping on their stomachs, and do not adjust to the changed position well. Moreover after 5–6 months, most infants can roll themselves over to their preferred sleeping position. Further, many infants have a tendency to regurgitate and parents are concerned their infant may choke on the regurgitated matter.

Therefore, it is desirable to provide a mattress which will support an infant comfortably, and provide for a supply of fresh air to combat the effects of the carbon dioxide of exhaled air lingering near the infant's head.

In an effort to prevent such asphyxiation, mattresses have been developed that include air pumps to circulate oxygen to flush at the carbon dioxide. Hargest (U.S. Pat. No. 5,317,767) discloses an air pump interconnected with an air tube residing within the mattress. The air pump stimulates the circulation of fresh air. Watkins (U.S. Pat. No. 5,305,483) discloses a pillow portion having two layers, the upper layer being of porous, air permeable foam, the lower layer containing an air pocket to which an air pump is connected.

The present invention does not require an air pump, and is therefore easier to use and easier to transport. Because there are no additional motorized parts, the parent or caregiver need not stand vigilance over the mattress to ensure it is operational.

Further, in previous mattresses, only the head portion of the mattress serves to circulate air. Hargest discloses a separate body pad that is connected to the pillow with air circulating means. Ormerod (U.S. Pat. No. 3,339,216) discloses a mattress having a resilient impermeable, imperforate portion and an air permeable pillow portion with a series of perforations. If the infant should be very active in its sleep and move itself off the pillow portion, the purpose of providing fresh air to the head portion of the mattress is defeated.

The present invention provides fresh air at all points of the mattress, regardless of which direction the infant may end up facing. Moreover, because of this feature, the mattress may be turned, or flipped and still function, prolonging the useful life of the invention.

BRIEF SUMMARY OF THE INVENTION

The present invention involves an apparatus and a method for preventing a possible cause of Sudden Infant Death Syndrome (SIDS) by furnishing a fresh supply of air to a sleeping infant, while supporting the infant in a comfortable fashion.

More specifically, the invention includes a lightweight frame, sized to fit in the infant's sleeping environment, i.e., bassinet, or crib, and an air permeable material fitted to the frame. The material is of a strength that it will support the infant's weight and maintain its shape sufficiently to allow fresh air to flow to the head and mouth area of the infant.

The frame is of a sufficient depth that the air space created beneath the infant is large enough to provide an amply supply of fresh air. The material is further of a nature that the infant is comfortable resting directly on it, and additional sheets or blankets are not necessary to line the bassinet or crib. An air permeable, thin sheet, such as an open weave cloth, may be used so long as it does not interfere with the purpose of the invention.

In one embodiment of the invention, the air permeable material is a polyester mesh material. It is cut and formed in a case configuration so that it may be slipped over the frame. The open end is tightly closed, either with lacings or hook and loop fasteners, such as the type sold under the trademark VELCRO®, so that the weight of an infant is supported and does not infringe on the air space created between the upper and lower sides of the mesh casing.

In another embodiment of the invention, the air permeable material is an open cell foam of a particular resiliency to support an infant's weight and retain its general shape so that air may flow through the open cells. The foam is cut to slightly larger than the interior of the frame so that when fit into the frame it is snugly contained. Alternatively, the foam is cut directly to fit the bassinet or crib without the frame.

As the invention does not require a device to circulate air, it is easy to use and transport. The infant's breath stimulates circulation of the supply of air within the material to counter the effects of carbon dioxide which may linger near the infants head and breathing passages.

Further, because the infant can face in any direction, on either side, there is less need to monitor the infant during its sleep. Also, because of this versatility, the mattress may be flipped or turn should one side be stained, thereby extending the life of the mattress.

Other objects, features and advantages of the present invention will become apparent from the following more detailed description in combination with the following drawings.

DETAILED DESCRIPTION OF THE PREFERRED EMBODIMENTS

Figure 1A:
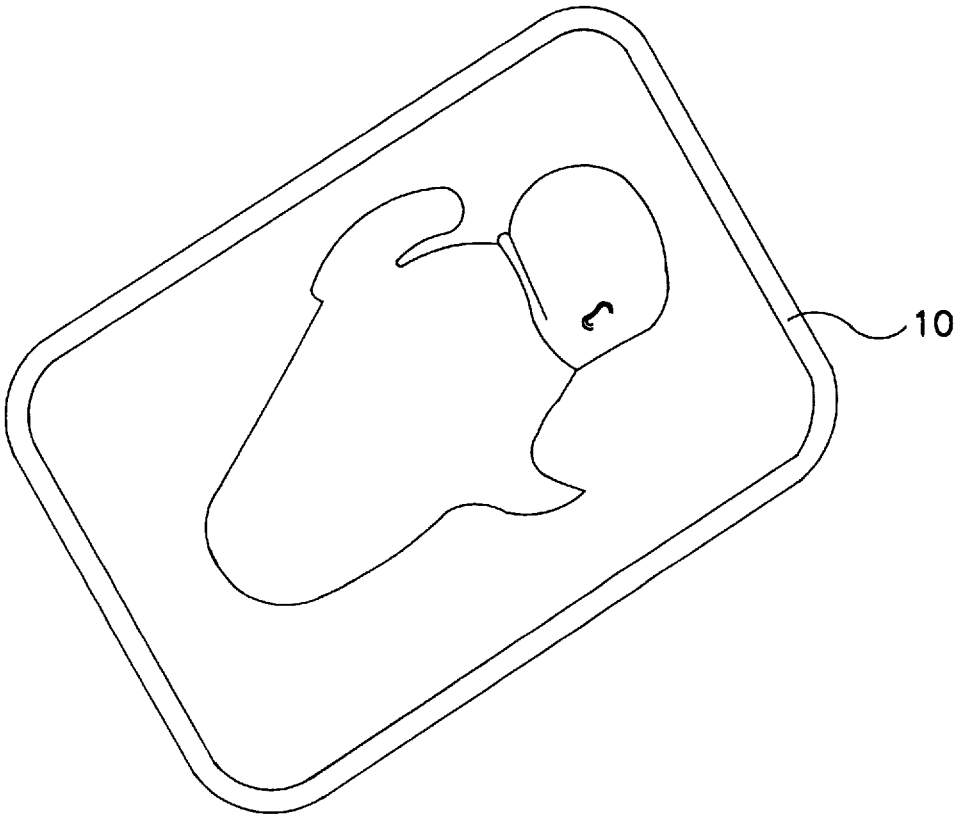
FIGS. 1*a* and 1*b* depict perspective and side views of an infant in a prone position on an embodiment of the invention.
Figure 1B:
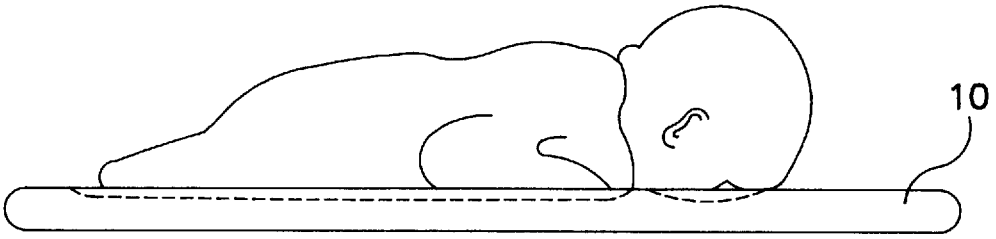

As shown in FIGS. 1*a* and 1*b*, the invention pertains to a mattress 10 for bassinets or cribs that supports an infant's weight and provides for the flow of fresh air to the infant's head and air passages.

Figure 2:
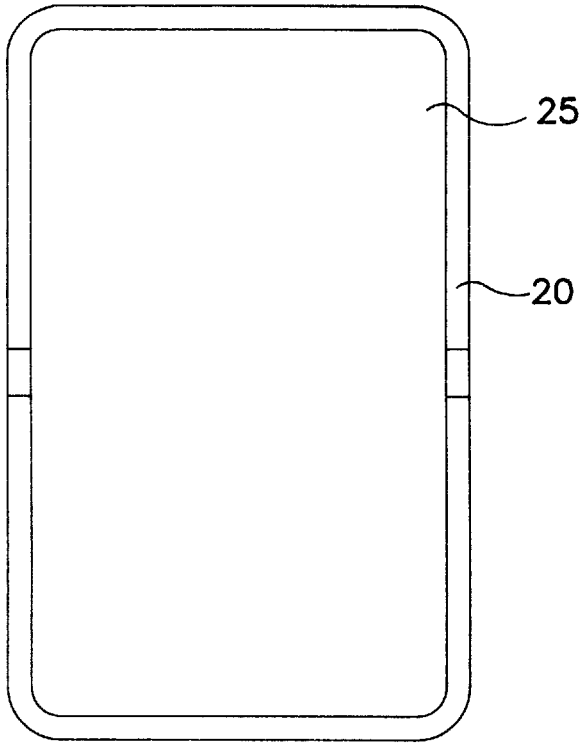
FIG. 2 is an overhead view of an embodiment of the invention showing the general configuration of the frame and air permeable material.
Figure 3:
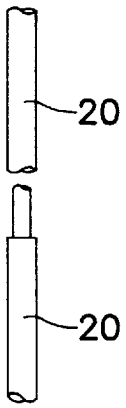
FIG. 3 is a sectional view of the frame in one embodiment showing the interconnection of the frame pieces.

An embodiment of the invention, as illustrated in FIG. 2, comprises frame 20, which is preferably in the shape of a bassinet or crib, fitted with an air permeable material 25. Air permeable material 25 forms a body and head support for an infant and allows for a supply of fresh air around the infant. The fresh air enclosed within mattress 10 flows through air permeable material 25 to counterbalance the effects of the carbon dioxide from exhaled air that may linger near the infant's head. The magnitude of the air supply is defined by the thickness of the mattress. In order to ensure an ample fresh air supply, it is preferable that frame 20, and thus mattress 10, be of a sufficient thickness when supporting an infant's weight. The applicant has found that an ample air supply is available when mattress 10 has a thickness of 2¼" when supporting an infant. Frame 20 may be formed of any material, such as aluminum, or wood. In the preferred embodiment frame 20 is of molded plastic, which is inexpensive and relatively easy to shape, and provides for a lightweight, easily transported frame. Frame 20 may be either a single piece, or several pieces slidably attached, as shown in FIG. 3.

Figure 4:
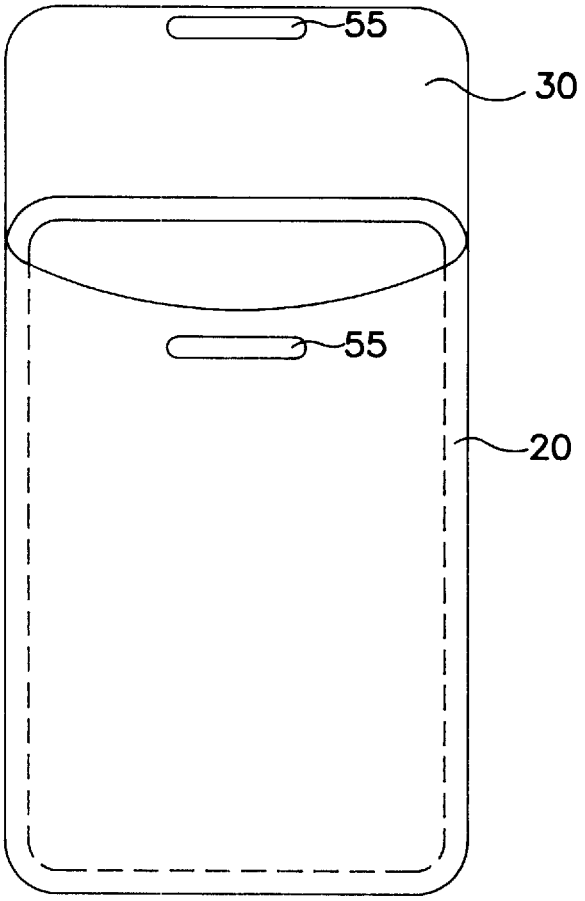
FIG. 4 is an overhead view of the first alternative exemplary embodiment of the invention, illustrating the placement of casing and frame, and the fastener on the casing.
Figure 5A:
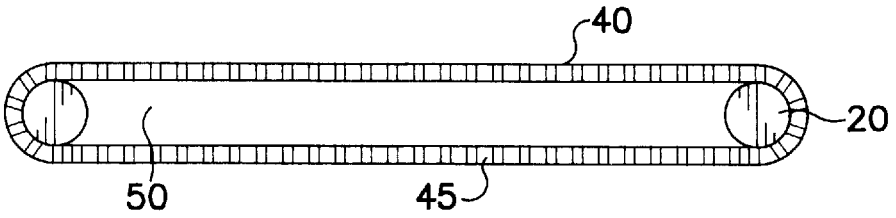
FIGS. 5*a* and 5*b* are cross-sectional views of the embodiment shown in FIG. 4, illustrating the effect of an infant's weight on the apparatus.
Figure 5B:
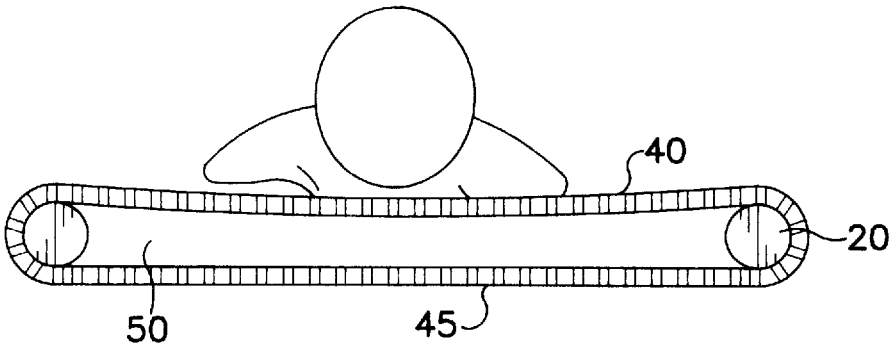

In one embodiment of the invention, air permeable material 25 comprises a casing 30 of mesh fabric, as further illustrated in FIG. 4. Casing 30 slides over frame 20 and is tightly closed by a fastener 55, thereby forming upper and lower surfaces 40 and 45 of the mattress and enclosed air space 50. As best seen in FIGS. 5*a* and 5*b*, casing 30 is so tightly secured that surfaces 40 and 45 are resilient, and do not collapse under the weight of an infant. As FIG. 5*b* shows, although upper surface 40 does yield some under the weight of the infant, so that the infant is comfortably supported, the overall shape of the surface is retained, and air space 50 is generally not obstructed. Casing 30 may be of any mesh fabric that is soft to touch, as it will be directly against the infant's body. It is further desired that the material contain large enough openings so that any regurgitated matter will not clog the openings and obstruct the flow of air. Rather, the matter will seep through the fabric and away from the infant's mouth. Casing 30 preferably comprises a polyester mesh material usually used to make light-weight football jerseys manufactured by Lawrence Manufacture, a division of Ames Textile of Lowell, Mass., sold by Game Time of Glendale, Calif.

Figure 6:
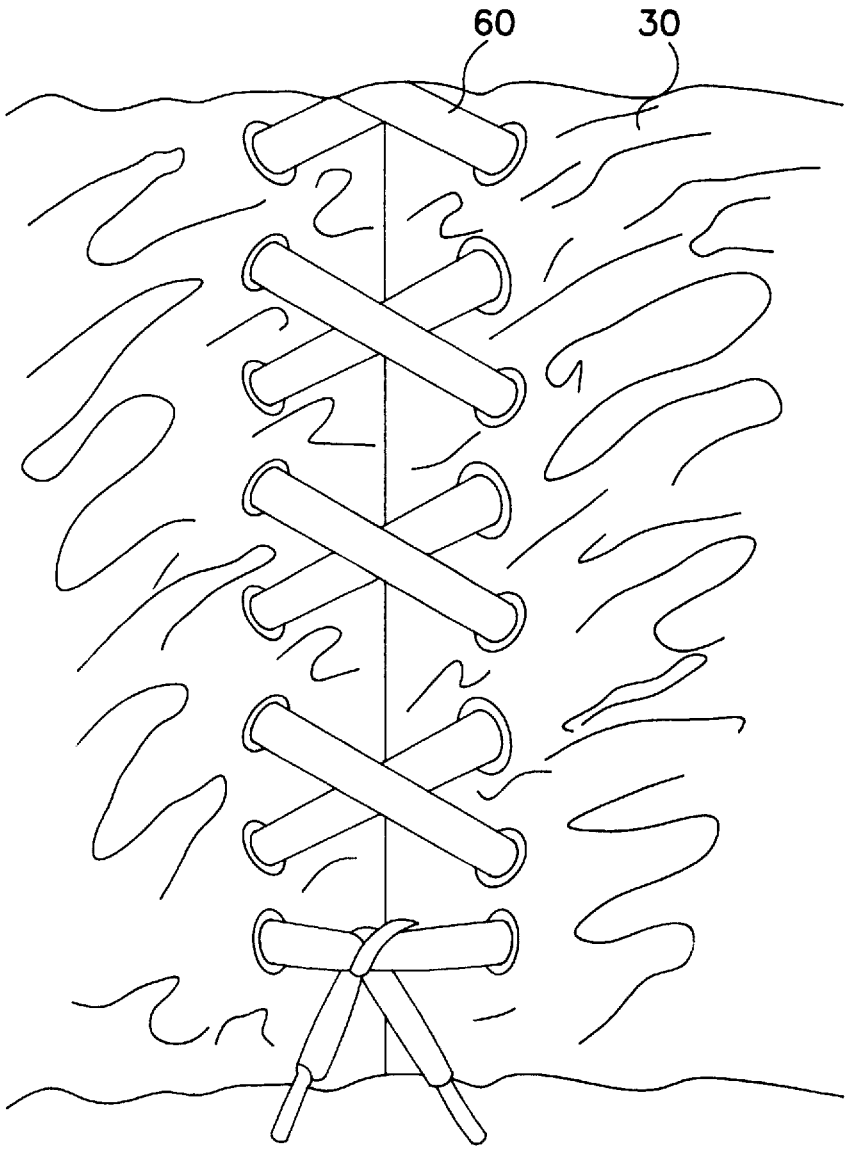
FIG. 6 is a sectional view of the lacing used as a fastening means in an embodiment as illustrated in FIG. 4.

Further, it is contemplated that fastener 55 is snaps, or a zipper, or stitching or other fastening mechanisms, which will close casing 30 tightly so as to create taut surfaces 40 and 45. It is preferred that the fastener utilize hook and loop fasteners, such as VELCRO®. Because hook and loop fasteners can be undone completely, casing 30 may be removed for cleaning and refit to frame 20 with relative ease. In another embodiment, fastener 55 is lacings 60 woven through the fabric as illustrated in FIG. 6, so that casing 30 may be tightened in the event casing 30 loses some of its elasticity after a substantial period of use.

Figure 7A:
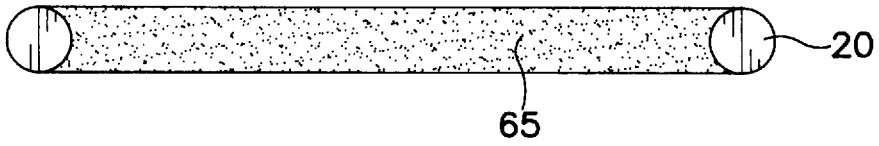
FIGS. 7*a* and 7*b* are cross-sectional views of the second alternative embodiment described below, illustrating the impact of an infant's weight on the apparatus.
Figure 7B:
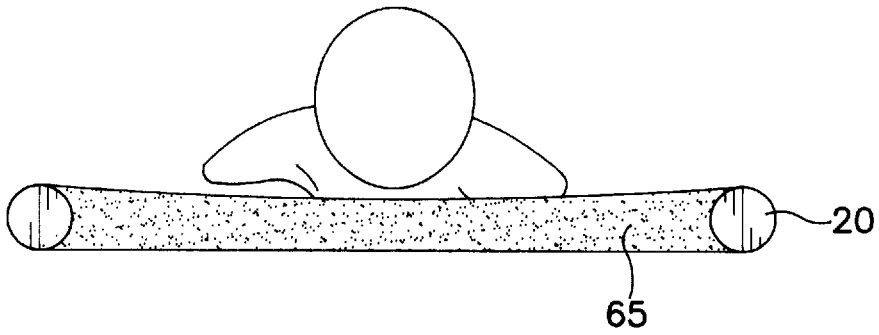

In another contemplated embodiment of the invention, air permeable material 25 comprises a porous open cell foam 65, preferably FOAMEX, manufactured by Foamex International of Ontario, Calif., cut to the shape of frame 20, and slightly larger than the interior of frame 20 so that when it is inserted, it is securely within the sides. Foam 65 has a sufficient elasticity so that, as illustrated in FIGS. 7*a* and 7*b*, under the weight of the infant, foam 65 retains its general shape and the air supply within foam 65 is not infringed on. The porous nature of foam 65 allows for the supply of fresh air to counterbalance the carbon dioxide present in the exhaled air that may be trapped in the air pockets of bedding about the infant's head. In an alternative embodiment, the open cell foam is cut to directly fit the bassinet or crib.

It will be appreciated from the foregoing that the invention represents a significant advance in the field of mattresses for infants. In particular, the invention provides a lightweight, easily transported mattress that provides a supine infant with fresh air and counters the potentially lethal effect of carbon dioxide. As the invention does not include a motorized or other non-ambient source of air circulation, it does not require the vigilant monitoring by a parent or caregiver, and may be placed in almost any setting. Although intended for use with a bassinet or crib, it is appreciated that the mattress may be used alone on the floor, or in a playpen, or other area an infant may nap. Moreover, it will be appreciated that the air permeable material is easily removed for cleaning and replacement, which extends the life of the mattress.

It will also be appreciated that although specific embodiments of the invention have been described in detail by way of example, various modifications may be made without departing from the scope and spirit of the invention, which should not be limited except as by the accompanying claims.

What is claimed is:

1. A mattress for the prevention of sudden infant death syndrome comprising:

a frame forming a top surface, bottom surface and side surface; and an air permeable material having a top surface disposed in substantially the same plane as the top surface of said frame, a bottom surface disposed in substantially the same plane as the bottom surface of said frame and a side surface disposed adjacent to the side surface of said frame wherein the air permeable material is a mesh fabric casing having an open end, and further comprising a fastening means for closing and tightening the mesh fabric casing about the frame.

2. The mattress as defined in claim 1, wherein the fastening means for closing and tightening the casing comprises lacing woven through the fabric.

3. The mattress as defined in claim 1, wherein the fastening means for closing and tightening the case comprises hook and loop fasteners.

4. The mattress as defined in claim 1, wherein the frame is molded plastic.

5. A method for providing fresh air to an infant in a face down prone position, comprising the steps of:

providing an air permeable mattress including a frame forming a top surface, bottom surface and side surface, and an air permeable material having a top surface disposed in substantially the same plane as the top surface of said frame, a bottom surface disposed in substantially the same plane as the bottom surface of said frame and a side surface disposed adjacent to the side surface of said frame; and placing an infant on the air permeable mattress so that when the infant is in a face down position the infant's breath stimulated circulation of fresh air through the mattress.

* * * * *

UNITED STATES PATENT AND TRADEMARK OFFICE

CERTIFICATE OF CORRECTION

PATENT NO. : 5,857,232

DATED : January 12, 1999

INVENTOR(S) : Mahdavi

It is certified that error appears in the above-identified patent and that said Letters Patent is hereby corrected as shown below:

Title page, item [54] and col. 1, line 1, delete "Basinets" to --Bassinets--

Signed and Sealed this

Third Day of October, 2000

*Attest:*

Q. TODD DICKINSON

*Attesting Officer*

*Director of Patents and Trademarks*